US005240535A

United States Patent [19]

Liverhant

[11] Patent Number: 5,240,535

[45] Date of Patent: Aug. 31, 1993

[54] REUSABLE VINYL TAPE FOR SECURING HOCKEY EQUIPMENT EXTERNALLY

[76] Inventor: Charles Liverhant, Fort George Hill Post Office, 4558 Broadway, New York, N.Y. 10040

[21] Appl. No.: 957,013

[22] Filed: Dec. 10, 1992

[51] Int. Cl.[5] ..... B65H 81/00

[52] U.S. Cl. ..... 156/189; 156/190

[58] Field of Search ..... 156/189, 190; 602/58, 602/64, 65, 66, 42, 26

[56] References Cited

U.S. PATENT DOCUMENTS

| | | | |
|---|---|---|---|
| 2,013,757 | 9/1935 | Jung, Jr. | 602/66 |
| 3,375,821 | 4/1968 | Meek | 602/26 |
| 4,085,746 | 4/1978 | Castiglia | 602/65 |
| 4,187,844 | 2/1980 | Caprio, Jr. | 602/65 |
| 4,832,010 | 5/1989 | Lerman | 602/65 |
| 5,031,240 | 7/1991 | Nierhaus | 602/26 |
| 5,154,690 | 10/1992 | Shiono | 602/26 |

*Primary Examiner*—Jenna L. Davis
*Assistant Examiner*—Blaine Copenheaver

[57] ABSTRACT

A reusable tape for effectively securing hockey equipment against shifting of the equipment during play. The tape is designed to be wrapped over the equipment and around the leg in precisely the same manner as is disposable adhesive athletic tape when used for this purpose. The tape is further designed to enable it to be measured and cut to particular lengths, so that it duplicates the precise functioning of whatever particular lengths of adhesive athletic tape is normally preferred by each player.

The tape consists of an elongated, rectangular strip of vinyl from 30" in length to 240", in widths of 1" to 1½", in different solid colors to match team uniforms, including white, black, and clear.

4 Claims, No Drawings

REUSABLE VINYL TAPE FOR SECURING HOCKEY EQUIPMENT EXTERNALLY

FIELD OF THE INVENTION

The invention relates to the securing of protective equipment used by hockey-players, against shifting of the equipment during play using strips of vinyl, applied in the manner that disposable adhesive athletic tape is commonly used by hockey-players for this purpose. More particularly, vinyl can be reused indefinitely for this purpose, whereas disposable athletic tape is not reusable.

BACKGROUND OF THE INVENTION

Among hockey-players, it is common practice to make use of disposable adhesive athletic tape in order to secure protective leg pads against shifting of the equipment during play. Typically, the player applies a length of disposable adhesive athletic tape over the equipment to secure it to the leg. The amount of tape used for this purpose varies from player to player, but it is typical for players to use approximately half a roll of tape, wrapping it over the equipment and around the leg in two places: just below the knee and also, either just above, or just below the top of the skate.

Older products intended for this purpose are very inefficient in actual use; they require buckles, button snaps or VELCRO pads to keep themselves in place. Furthermore, these older products are manufactured from various types of elastic, or elasticized cloth-like material, such materials do not perform well because lengths of material exceeding one leg-circumference cannot be wrapped around the leg without impairing blood circulation to the legs and feet. Neither elasticized cloth, nor other materials intended for securing equipment onto a leg can simply be tossed into a player's equipment bag between uses because they absorb moisture and therefore require airing out between uses as well as periodic washing. Only vinyl is sufficiently rigid that it does not become entangled with equipment or form into knots that require disentangling, as do straps manufactured from cloth-like materials. These factors account for the fact that very few players use older products of this type--they simply do not perform as efficiently as disposable adhesive tape, use of which continues to be the method preferred by players to secure protective equipment to the leg.

The instant invention simulates all the essential properties of disposable tape in that it can be applied in a manner identical to that with which disposable tape is applied by the player. Specifically, vinyl is virtually inelastic, this facilitates its mechanical functioning, and accounts for its similarity in "feel" to disposable tape. Furthermore, the electrostatic, intra-molecular, self-adhesive property of vinyl makes unnecessary the use of any adhesive or mechanical fastening device. Similarly, once the loose end of the strap is smoothed against the underlying layer of the material, it adheres to itself and will not become unraveled--similar in principle to vinyl shower curtains that stick together.

The primary value of the product to players is economic as disposable tape is relatively expensive to use over the course of a full season. The instant invention is designed to allow players to purchase strips in pre-cut lengths, or to cut shorter, customized-length strips.

SUMMARY OF THE INVENTION

The instant invention comprises strips of vinyl of various length, width, and thickness: from 30" to 240", from 1" to 1½", and from 8-gauge to 12-gauge, respectively.

Vinyl is sufficiently strong that it will withstand the tensile load resulting from its being applied by the player in the manner of disposable tape, when used for the purpose of securing protective equipment against shifting by wrapping externally over the equipment and around the leg.

Unlike older elastic, cloth, or cloth-like products intended as substitutes for athletic tape, vinyl tape can be used in lengths identical to lengths of disposable tape without impairing blood circulation, and it does not require any additional fastening device; thereby duplicating efficiently, the precise "feel" and mechanical functioning of disposable athletic tape when used for this purpose. Because vinyl does not absorb moisture, it requires neither airing-out between uses nor periodic washing, as does cloth material. Similarly, vinyl is sufficiently rigid that it does not become entangled with other equipment in the player's bag, or form knots that require disentangling between uses.

DETAILED DESCRIPTION OF THE PREFERRED EMBODIMENT

The vinyl tape is comprised of an elongated rectangular inelastic panel. The securing effected by the instant invention is particularly designed to prevent slippage of the protective equipment over which the invention is applied.

It is desirable for the protective hockey equipment worn over the front of the lower leg to maintain its position in a stable and secure manner for the duration that it is worn. Accordingly, a strap comprised of vinyl, constructed in accordance with the instant invention is capable of providing the same restriction of equipment slippage heretofore achieved by disposable, adhesive athletic tape applied in the same manner as that described as the preferred method of application of the instant invention.

The use of vinyl material for this invention is responsible on its own, for providing functional restriction of equipment slippage identical in efficiency to that provided by disposable adhesive athletic tape at a considerable reduction in expense, owing to the reusable nature of the strap.

I claim:

1. A method of securing protective equipment to a hockey-player's leg by wrapping a reusable vinyl strap over the equipment and around the leg, said vinyl strap comprising:

a rectangular strip of 8-gauge to 12-gauge vinyl in lengths of 30" to 240", in widths of 1" to 1½", in a solid color.

2. A method according to claim 1 wherein the vinyl strap is 120" to 240" and can be measured and cut into shorter, customized-length strips.

3. A method according to claim 1 wherein the vinyl strap is transparent.

4. A method according to claim 2 wherein the vinyl strap is transparent.

* * * * *